US009816393B2

(12) United States Patent
Simon-Delgado et al.

(10) Patent No.: US 9,816,393 B2
(45) Date of Patent: Nov. 14, 2017

(54) TURBINE BLADE AND TURBINE WITH IMPROVED SEALING

(71) Applicant: ALSTOM Technology Ltd, Baden (CH)

(72) Inventors: Carlos Simon-Delgado, Baden (CH); Christoph Didion, Wettingen (CH); Stefan Biedermann, Fislisbach (CH); Beat Von Arx, Trimbach (CH); Thomas Zierer, Ennetbaden (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 553 days.

(21) Appl. No.: 14/336,152

(22) Filed: Jul. 21, 2014

(65) Prior Publication Data

US 2015/0037167 A1 Feb. 5, 2015

(30) Foreign Application Priority Data

Jul. 31, 2013 (EP) ..... 13178679

(51) Int. Cl.
*F01D 25/12* (2006.01)
*F01D 5/14* (2006.01)
(Continued)

(52) U.S. Cl.
CPC ..... *F01D 25/12* (2013.01); *F01D 5/081* (2013.01); *F01D 5/142* (2013.01); *F01D 5/147* (2013.01);
(Continued)

(58) Field of Classification Search
CPC ..... F01D 25/12; F01D 25/145; F01D 5/046; F01D 5/081; F01D 5/142; F01D 5/147;
(Continued)

(56) References Cited

U.S. PATENT DOCUMENTS 3,551,068 A 12/1970 Scalzo et al.
3,974,646 A 8/1976 Markowski et al.
(Continued)

FOREIGN PATENT DOCUMENTS

CN 202370590 U 8/2012
EP 1 079 070 2/2001
(Continued)

OTHER PUBLICATIONS

Office Action (Notice of Preliminary Rejection) dated Oct. 30, 2015, by the Korean Patent Office in corresponding Korean Patent Application No. 10-2014-0096314 and an English translation thereof. (9 pgs).

*Primary Examiner* — Dwayne J White
*Assistant Examiner* — Peter T Hrubiec
(74) *Attorney, Agent, or Firm* — Buchanan Ingersoll & Rooney PC

(57) ABSTRACT

The disclosure pertains to a turbine with a gas turbine blade and a rotor heat shield for separating a space region through which hot working medium flows from a space region inside a rotor arrangement of the turbine. The rotor heat shield includes a platform which forms an axial heat shield section and which is arranged substantially parallel to the surface of a rotor and a radial heat shield section at the upstream end of the axial heat shield section, which is extending in a direction away from the surface of the axial heat shield section towards the hot gas. Further the turbine comprises a blade rear cavity which is delimited by the downstream end of the platform and/or the downstream end of the blade foot, the radial heat shield section. The disclosure further refers to a gas turbine blade and a rotor heat shield designed for such a turbine.

17 Claims, 3 Drawing Sheets

(51) Int. Cl.
*F01D 5/08* (2006.01)
*F01D 11/00* (2006.01)

(52) U.S. Cl.
CPC ..... *F01D 11/001* (2013.01); *F01D 11/005* (2013.01); *F05D 2260/941* (2013.01)

(58) Field of Classification Search
CPC .... F01D 11/001; F01D 11/005; F01D 11/008; F05D 2260/941
See application file for complete search history.

(56) References Cited

U.S. PATENT DOCUMENTS 5,827,047 A * 10/1998 Gonsor ..... F01D 5/22 416/193 A
5,947,687 A 9/1999 Mori et al.
6,761,536 B1 * 7/2004 Bash ..... F01D 5/18 416/193 A
7,220,099 B2 * 5/2007 Bekrenev ..... F01D 11/005 415/173.7
8,105,024 B2 * 1/2012 Khanin ..... F01D 11/001 415/170.1
8,402,768 B2 3/2013 Syed et al.
8,677,756 B2 3/2014 Poyyapakkam et al.
2012/0260622 A1 10/2012 Poyyapakkam et al.
2012/0272659 A1 11/2012 Syed et al.

FOREIGN PATENT DOCUMENTS

EP 2 039 886 3/2009
JP 2000-230401 8/2000
JP 2002-213205 7/2002
JP 2005-180431 7/2005
WO 2008/074633 6/2008
WO 2011/054739 A2 5/2011
WO 2011054766 A2 5/2011

* cited by examiner

TURBINE BLADE AND TURBINE WITH IMPROVED SEALING

CROSS-REFERENCE TO RELATED APPLICATIONS

This application claims priority to European application 13178679.0 filed Jul. 31, 2013, the contents of which are hereby incorporated in its entirety.

TECHNICAL FIELD

The present invention relates to a gas turbine moving blade, and more particularly to a gas turbine blade having a platform undercut with an improved seal line. Further, it relates to a turbine heat shield for shielding the undercut, and a turbine comprising the heat shield-blade combination.

BACKGROUND

Gas turbine blades, are exposed to high temperature combustion gases, and consequently are subject to high thermal stresses. Methods are known in the art for cooling the blades and reducing the thermal stresses. Typically high pressure air, discharged from a compressor, is introduced into an interior of an air-cooled blade from a blade root bottom portion. The high pressure air, after cooling a shank portion, a platform and an airfoil, flows out of fine holes provided at a blade face, or out of fine holes provided at a blade tip portion. Also, fine holes can be provided at a blade trailing edge portion of the blade, through which the high pressure air flows to cool the trailing edge of the blade. Fine holes can be provided on the platform surface for cooling. Thus, the high pressure air cools the metal temperature of the moving blade.

Highly cooled gas turbine blades experience high temperature mismatches at the interface of the hot airfoil and the relatively cooler shank portion of the platform. These high temperature differences produce thermal deformations at the platform, which are incompatible with those of the airfoil. In addition to thermal stresses large centrifugal forces act on the blade during operation adding to the stresses in the blade. When the airfoil is forced to follow the displacement of the shank and platform, high thermal stresses occur on the airfoil, particularly in the thin trailing edge region. These high thermal stresses are present during transient engine operation as well as steady state, full speed, full load conditions, and can lead to crack initiation and propagation. These cracks potentially can ultimately lead to catastrophic failure of the component.

The U.S. Pat. No. 5,947,687 discloses a gas turbine moving blade (FIGS. 1-3) having a groove on the trailing side of the platform of a turbine blade, designed to suppress a high thermal stress at the attachment point of the airfoil trailing edge and platform that occurs during transient operating conditions, i.e., starting and stopping of the turbine. This groove extends along the entire length of the platform, from the pressure side (typically with a concave curvature) of the blade to the suction side (typically with a convex curvature) along a circumference of the turbine, typically parallel to a plane of rotation of the turbine. In operation there is no effective seal between the trailing edge of the platform and subsequent vane platform or heat shield downstream of blade. The groove is typically open to a gap, which is purged by cooling air, and is facing the hot gas path of the turbine. If the purge flow is interrupted or the pressure distribution on the hot gas side is not as intended hot gas can be ingested through the gap and lead to local overheating of the groove and potentially overheating of the blade foot as well as of the turbine rotor.

Below the groove the turbine blade is connected to the rotor. The mechanical connection can for example be done with fir tree having a tapered form, with broached serrated edges providing multiple load-bearing faces. Below or between the feet of the blades cavities to supply pressurized cooling air to the blade are provided. To the axial downstream end of the blade these cavities can for example be closed by a shiplap, i.e. an overlap extending from one blade foot in circumferential direction beyond the neighboring blade foot. A shiplap makes assembly and disassembly of blades, especially of individual blades for repair difficult. In addition, a shiplap has limited sealing capabilities as the overlap has practically no mechanical flexibility.

A turbine heat shield as known for example from the EP1079070 is a device for separating a space region through which hot working medium flows from a preferably coolable space region inside a rotor arrangement of a gas turbine.

Such a heat shield arrangement has at least two rotor discs, which are arranged one behind the other in the axial direction, can be fixedly connected to one another by means of at least one connecting region and are spaced apart from one another at least in the region of their radial circumferential edges. A heat shield arrangement further is of sheet-like design, is arranged between two adjacent rotor discs and has two connecting edges, along which the heat shields can be brought into operative connection in each case in the region of the circumferential edges of the adjacent rotor discs, and which covers an intermediate space which extends on the rotor side between the two rotor discs. The heat shield arrangements serve to shape the hot-gas passage provided in the interior of a gas turbine at its diameter facing the rotor and protect structural parts of the rotor from overheating.

The known heat shield designs and turbines with such heat shields require purging of the axial downstream end of the blade foot below the platform. The purge air used has a detrimental effect on turbine power and efficiency. In addition any mechanical defect or change in the purge air supply can cause insufficient local purging resulting in a local overheating of the downstream end of the blade or of the rotor disk holding the blade.

SUMMARY

The object of the present disclosure is to propose a blade, a heat shield, and a turbine comprising a blade-heat shield arrangement, which avoids high stresses in the blade trailing edge portion and assures safe efficient cooling of the downstream end of the blade foot as well as of the rotor disk holding the blades.

According to one embodiment a gas turbine blade comprises a platform having a trailing edge side, a pressure side, a suction side, and a leading edge side; an airfoil connected to the blade platform, and a first groove formed in the trailing edge side of the platform. The first groove extends between the blade pressure side and the blade suction side. In axial direction the first groove extends below the root of the trailing edge of the airfoil. The root of the trailing edge is the location where the trailing edge of the airfoil intersects the platform (the root can be rounded at the transition between trailing edge and platform to reduce local stresses). The blade further comprises a trailing edge side seal groove formed in the trailing edge side of the blade platform closer to a platform surface facing the airfoil than the first groove, wherein the trailing edge side seal groove extends between the blade pressure side and the blade suction side, and wherein the depth of the trailing edge side seal groove in axial direction is smaller than the depth of the first groove.

Different types of seal grooves are known. A seal groove is any geometrical arrangement suitable for holding a seal. It can for example be a continuous notch for inserting a seal. It can be formed of fillets extending from the surface or combination of a rides, flange and fillets. A seal can be held by one groove, or a plurality of groves. For many seal types like for example a strip seal a groove has to be provided on both parts between which a gap is to be sealed.

Typically a blade further comprises a foot below the platform (on the side facing away from the airfoil). The foot and platform can also be one integrated design.

The pressure respectively suction side are the sides of the blade, i.e. also of the platform which are on the pressure, respectively suction side of the airfoil.

Specifically, the first groove can have an axial depth that enters into a line of stress created by the blade load.

More specifically, the trailing edge seal grove can have an axial depth that does not enter into a line of stress created by the blade load According to a further embodiment the trailing edge side seal groove can be configured to hold a strip seal.

According to another embodiment the blade comprises a seal groove, which is extending to the trailing edge of the platform on the pressure side of the platform and/or on the suction side of the platform for receiving a main seal above the first groove. The seal groove for the main seal on the pressure side of the platform and/or on the suction side can extend towards the leading edge of the platform.

According to just another embodiment the blade comprises a seal groove on the pressure side of the platform and/or on the suction side of the platform for receiving a rear seal, which is extending from the main seal groove radially inwardly below the first groove.

According to a further embodiment the blade comprises a lower seal groove formed in the trailing edge side of the foot of the blade below the first groove for receiving a lower seal. The lower seal groove extends between the blade pressure side and the blade suction side. The depth of the lower seal groove extending in axial direction is smaller than the depth of the first groove.

Besides the blade a rotor heat shield suitable to assemble a turbine in combination with the blade described above is an object of the disclosure.

Such a turbine has at least two rotor disks, which are arranged one behind the other in the axial direction. Blades can be attached to the rotor disks and heat shields can be arranged to form a ring like structure between two turbine stages covering the rotor.

A gas turbine rotor heat shield for separating a space region through which hot working medium flows from a space region inside a rotor arrangement of a gas turbine through which coolant flows, comprises a platform which forms an axial heat shield section and which is typically arranged substantially parallel to the surface of a rotor. According to one embodiment the rotor heat shield comprises a radial heat shield section arranged at one end of the axial heat shield section, and extending away from the axial section in a direction towards the hot gas side.

In this context a substantially parallel direction can for example be in a range of up to 30° or more. Typically it is less than 20° or less than 10°. This limitation serves to distinguish an axial turbine, which is the object of this disclosure, from a radial turbine.

According to one embodiment the angle between the axial heat shield section and the radial heat shield section is more than 30° preferably more than 60° in a direction away from the surface of the axial heat shield section towards the hot gas side. The hot gas side of the heat shield is the side of the heat shield which is closer to the hot gas flow of a gas turbine when installed and in operation. The hot gas side of the axial heat shield section typically is not directly exposed to the hot gases but can be protected from the hot gases by an inner vane platform. Typically the space between the inner vane platform and heat shield is purged with a cooling fluid.

In this context the axial extension is the extension of the heat shield or of the blade in a direction parallel to the axis of the gas turbine when installed in the engine. The radial extension is the extension of the heat shield or of the blade in a direction normal to the axis of the gas turbine when installed in the engine.

According to another embodiment the axial heat shield section of rotor heat shield comprises a seal groove on the pressure side of the axial heat shield section and/or on the suction side of the axial heat shield section for receiving an axial platform seal. When installed in the engine the axial heat platform seal is used for sealing a gap between the axial heat shield sections of adjacent rotor heat shields.

According to yet another embodiment the radial shield section comprises a seal groove on the pressure side of the radial heat shield section and/or on the suction side of the radial heat shield section for receiving a radial heat shield seal. With the radial heat shield seal the gap between the radial heat shield sections of adjacent rotor heat shields can be sealed in the installed state of the heat shields. The axial and radial seal grove can also be combined to form a seal grove extending from the axial heat shield section to the radial heat shield section for receiving one combined seal.

Besides the blade and heat shield a turbine comprising such blades and seals is disclosed. Such a turbine has gas turbine blades comprising a platform with a trailing edge side, a pressure side, a suction side, and a leading edge side, an airfoil connected to the blade platform, and a first groove formed in the trailing edge side of the platform. In circumferential direction the first groove extends between the pressure side and the suction side. In axial direction the first groove extends below the root of the trailing edge of the airfoil. The root of the airfoil is the location where the trailing edge of the airfoil intersects the platform.

In addition such a turbine has a gas turbine rotor heat shield for separating a space region through which hot working medium flows from a space region inside a rotor arrangement of the gas turbine in which a coolant flows. The rotor heat shield comprises a platform which forms an axial heat shield section. The heat shield section can be arranged substantially parallel to the surface of a rotor, at an inclination relative to the surface of a rotor, or can have a curvature and delimits the hot gas flow path on the rotor side.

In this context a rotor arrangement has at least one rotor disk. Typically a rotor arrangement has two rotor discs, which are arranged one behind the other in the axial direction.

According to a first embodiment the rotor heat shield comprises a radial heat shield section at the upstream end of the axial heat shield section, and is extending in a direction away from the surface of the axial extension of the axial heat shield section. The downstream end of the blade foot, respectively the platform, and the radial heat shield section, delimited a blade rear cavity. This rear blade cavity can be feed by a cavity coolant.

Because the rear blade cavity is extending below the blade platform the sealing length of a seal sealing against a coolant leakage from the between adjacent platforms to the hot gas flow above the platform (into which the airfoils extends from the platform) is reduced. Correspondingly the coolant consumption is reduced because coolant flowing into the rear blade cavity can be used for cooling the heat shield and/or purging of the heat shield area or other components downstream.

According to one embodiment the radial heat shield section is extending at an angle of more than 30° preferably more than 60° in a direction away from the surface of the axial extension of the axial heat shield section.

In one embodiment the blade further comprises a trailing edge side seal groove formed in the trailing edge side of the blade platform closer to a platform surface facing the airfoil than the first groove. The trailing edge side seal groove extends between the pressure side and the suction side, and the depth of the trailing edge side seal groove in axial direction is smaller than the depth of the first groove in axial direction.

In a further embodiment the turbine comprises an upper seal arranged between the trailing edge side seal groove and the radial heat shield section. This seal further delimits the rear blade cavity and can reduce cavity coolant leakage to the hot gas flow path.

According to a another embodiment the blade of the turbine comprises a seal groove for receiving a rear seal on the pressure side of the platform and/or on the suction side of the platform and a rear seal extending radially inwardly below the first groove. The rear seal seals a space formed between adjacent blades of one turbine row at a downstream end towards the blade rear cavity. This space is pressurized with coolant during operation. During operation the bade can be supplied with blade coolant and the heat shield cavity can be supplied with cavity coolant from this space. The rear seal reduces leakage to the blade rear cavity, effectively leading to a two stage sealing at the downstream end of the blade.

The rear seal is typically a curved seal also called "Florida style seal" extending from the platform inwardly. At the platform the rear seal can be tangential to the platform's main seal. The inward end of the seal is typically at the downstream end of the blade foot.

According to yet another embodiment the blade comprises a lower seal groove formed in the trailing edge side of the platform or in the trailing edge side of foot of the blade below the first groove for receiving a lower seal, and a lower seal arranged between the a lower seal groove and the radial heat shield section. This seal separates the blade rear cavity from a heat shield cavity arranged radially inwardly of the axial heat shield section. This lower seal gives additional safety in case any of the seals from the blade rear cavity towards the hot gases fail. Even after such a failure the heat shield cavity would still be sufficiently sealed to assure cooling of the heat shield. In case of such a failure the blade rear cavity would be purged by increased leakage across the lower seal and the rear seal. For this embodiment the heat shield can comprise a lower seal grove formed in the front end of the axial heat shield section or in the upstream side of the radial heat shield section for receiving the lower seal.

The disclosed turbine with rear blade cavity allows to separate the downstream end of the blade from hot gases, and to reduce leakages. The fir tree and rotor are below the seal line. Because the downstream end of the blade foot can be sealed with individual seals no shiplap is required. Therefore easy assembly and disassembly of individual blades is possible. Further, the stresses in the airfoil trailing edges are reduced.

BRIEF DESCRIPTION OF THE DRAWINGS

The disclosure, its nature as well as its advantages, shall be described in more detail below with the aid of the accompanying drawings. Referring to the drawings.

DETAILED DESCRIPTION

Figure 1:
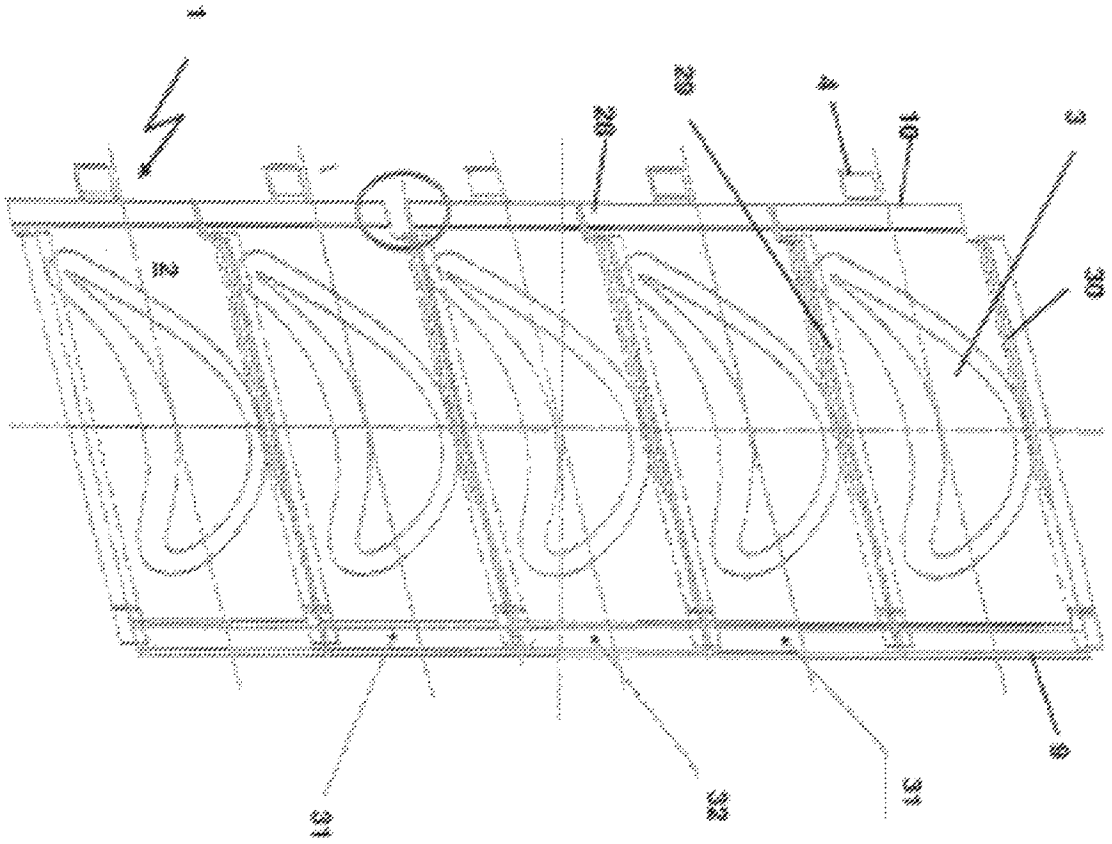
PRIOR ART FIG. 1
FIG. 1 shows a top view of a row or turbine blades.

FIG. 1 shows a top view of a section of a row or turbine blades. Each blade 1 comprises an airfoil 3 attached to a platform 2. The airfoil has a leading edge, a trailing edge, a concave pressure side and a convex suction side. The corresponding sides of the platform are the leading edge side 9, the trailing edge side 10, the pressure side 29, and the suction side 30. A foot 4 of the blade 1 is below the platform for fixation of the blade to a rotor. In this Figure only the rear end of the foot 4 is visible.

In the example of FIG. 1 the pressure side 29 and the suction side 30 of the platforms 2 of adjacent blades 1 are straight parallel lines, respectively surfaces along the extension of the platform 2 from the leading edge side 9 towards the trailing edge side 10. However, at the trailing edge side 10 of the platform 2 the platform of one blade is extended into the direction of a neighboring blade. The corresponding neighboring blade has a gap to allow an overlapping of the trailing edges of the platform 2 and of the foot 4 below (not shown) to form a so called ship lap. All standard blades 31 have a shiplap 28. Only one closing blade 32 does not have a shiplap 28, which can lead to additional leakages.

Figure 2:
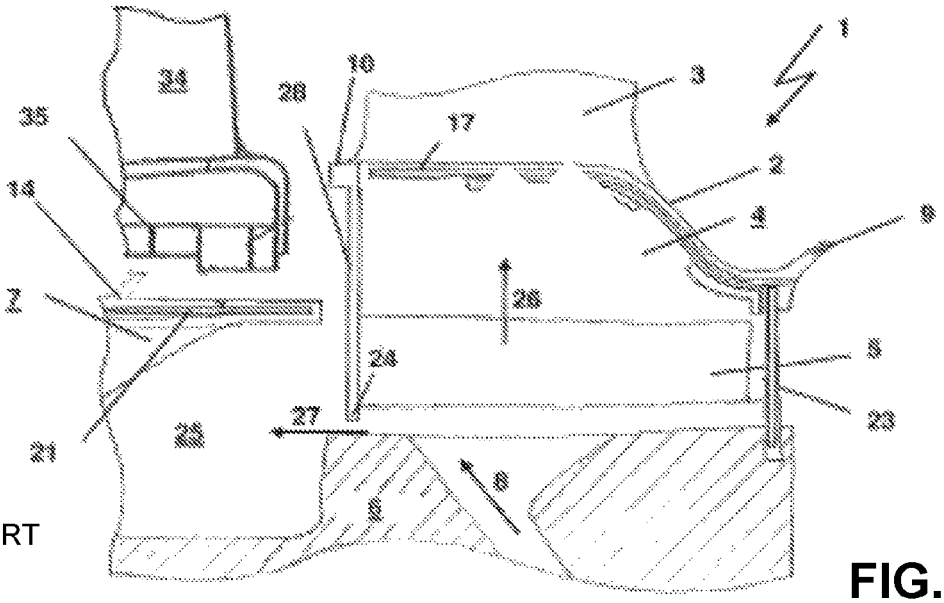
PRIOR ART FIG. 2
FIG. 2 shows a cut out of a turbine with a side view of a turbine blade and a section of the rotor holding the blade and the heat shield as well as a section of a vane facing the heat shield.

FIG. 2 shows a cut out of a turbine with a side view of a turbine blade 1 and a section of the rotor 6 holding the blade as well as a section of a heat shield 7. Above the heat shield 7 and downstream of the blade 2 a turbine vane 34 (only partly shown) is arranged. To reduce leakages in the gap between the heat shield 7 and an inner platform of the vane a honeycomb 35 can be attached to the vane 34 facing the heat shield 7.

The blade 1 comprises an airfoil 3 attached to a platform 2 and a foot 4. Part of the foot 4 can be designed as a fir tree 5 for fixation of the blade in the rotor. Coolant is supplied via a coolant feed 8 to the blade 1. Part of the coolant is supplied to the blade 1 as blade coolant 26 and part of the coolant is feed as cavity coolant 27 to a heat shield cavity 25 downstream of the blade. The flow of the cavity coolant 27 can be controlled by a throttle lug 24. Uncontrolled loss of coolant 8 to the heat shield cavity and in the region downstream of the platform 2 above the heat shield 7 is limited by the shiplap 28. Loss of coolant to the hot gas flow path above the platform 2 is limited by a main seal 17, which is sealing the gap between the platforms 2 of adjacent blades 1. Uncontrolled coolant flow at the upstream end of the blade can be limited by a lock plate interposed between the front ends of the feet 4 of adjacent blades 1 which extend from the rotor 6 to the inner side of the platform 2.

Loss of cavity coolant 27 is limited by axial platform seals 21 which are sealing the gap between the axial heat shield sections 14 of adjacent heat shields 7.

Figure 3:
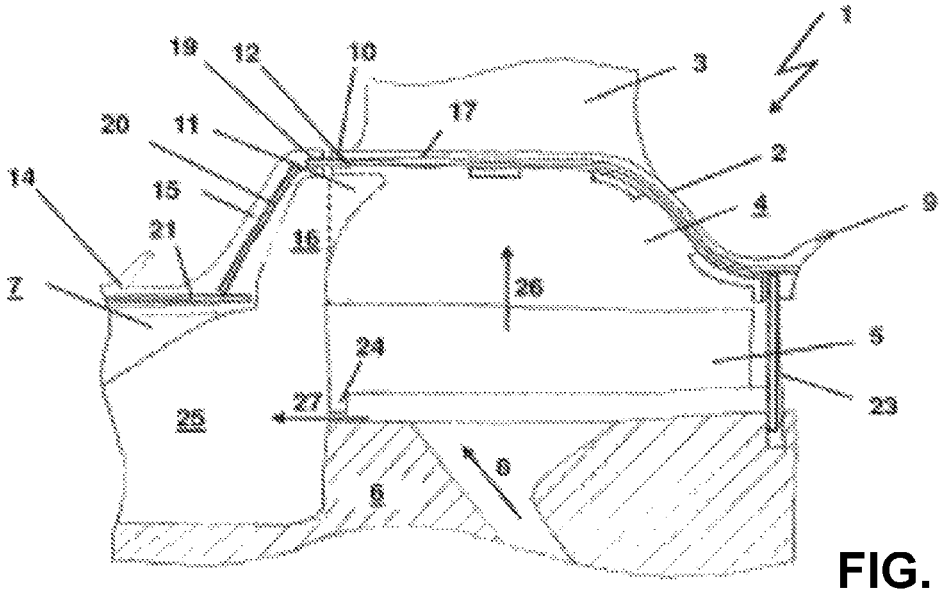
FIG. 3 shows a cut out of a turbine with a side view of a turbine blade and a section of the rotor holding the blade as well as a section of a heat shield and a rear blade cavity.

FIG. 3 shows a first embodiment of the disclosure with a side view of a turbine blade and a section of the rotor holding the blade as well as a section of a heat shield. FIG. 3 is based on FIG. 2 but the cut out vane section is omitted for simplification. The blade of FIG. 3 does not have a ship lab.

To reduce stresses in the trailing edge of the airfoil 3 a first groove 11 is "cut out" of the trailing edge side 10 of the platform 2, respectively out of the trailing edge side 10 of the foot 4. The groove is extending in radial direction from a position above the fir tree 5 to the platform 2. In axial direction the groove is extending from the trailing edge side 10 of the platform 2 up to a location upstream of the trailing edge of the airfoil 3. Consequently the trailing edge side 10 of the platform 2 is not rigidly connected to the foot 4 and therefore more flexible. Thus differences in thermal extension lead to lower stresses in the airfoil trailing edge.

The heat shield of FIG. 3 is based on the heat shield of FIG. 2. It additionally comprises a radial heat shield section 15, which, starting from outer surface of the axial heat shield section 14 at the upstream end of the axial heat shield section 14, extends radially outwards.

To protect the rear end of the platform 2 and the foot 4 of the blade 1 a blade rear cavity 16 is arranged downstream of the blade 1. It is enclosed towards the downstream side by the radial heat shield section 15 of the heat shield 7. To control the leakage towards the hot gas side (radially outwards) an upper seal 19 can be arranged between the trailing edge side 10 of the platform 2 and the outer end of the radial heat shield section 15. A trailing edge side seal groove 12 can be formed in the platform 2 adjacent the main seal 17. The trailing edge side seal groove 12 can be formed in the trailing edge side of blade platform closer to platform surface of the platform 2 facing the airfoil 3 than the first groove 11.

As shown in this embodiment the radial heat shield section 15 can have a kink at its radially outer end in upstream direction parallel to and in line with the heat shield 7 of the blade 1. This kink bridges the gap between heat shield 7 and the trailing edge side 10 of the platform 2. Further, it can serve to better hold the upper seal 19.

Figure 4:
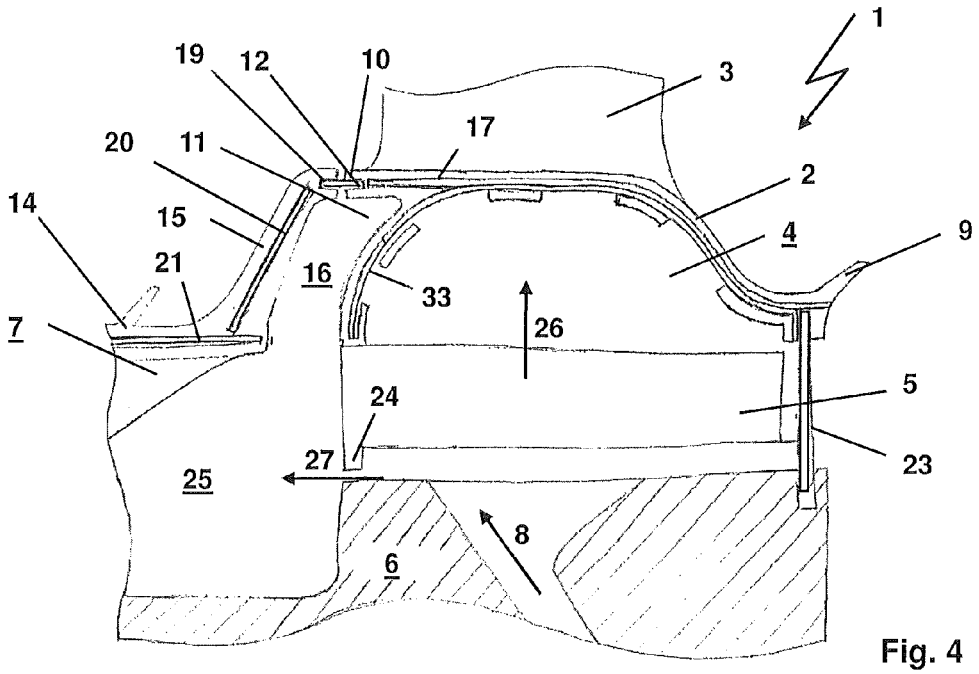
FIG. 4 shows a cut out of a turbine with a side view of a turbine blade and a section of the rotor holding the blade as well as a section of a heat shield, a rear blade cavity and a rear seal.

FIG. 4 shows a further refinement based on FIG. 3. In addition to the example shown in FIG. 3 this example comprises a rear seal 33, which is arranged at the downstream end of the foot 4. The rear seal 33 extends from the main seal 17 below the platform radially inwardly towards the fir tree 5 to control the leakage from the blade to the heat shield cavity 25 and in particular to the blade rear cavity 16.

Figure 5:
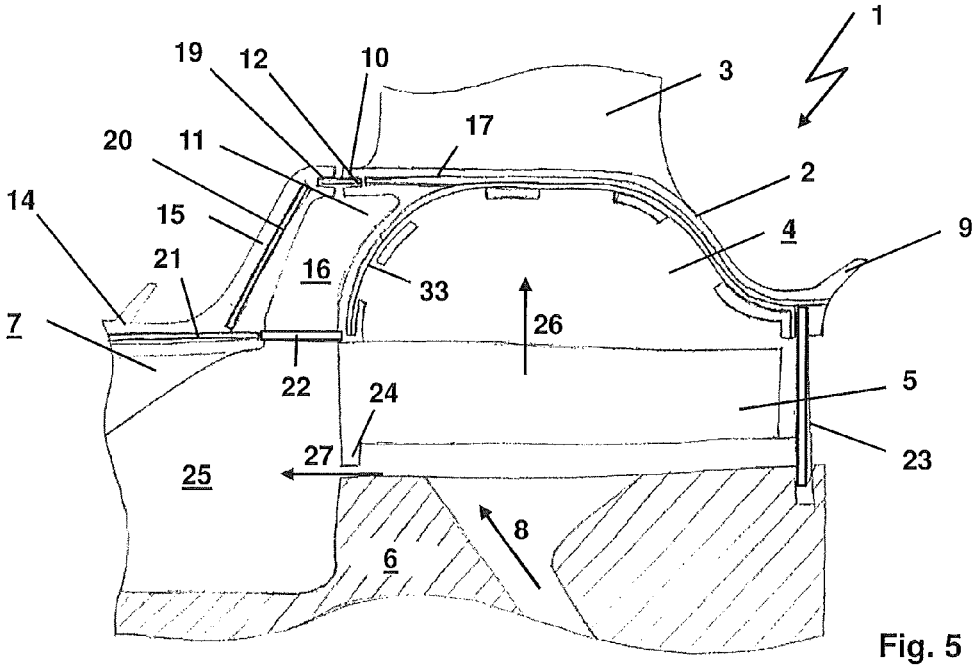
FIG. 5 shows a cut out of a turbine with an additional lower seal.

FIG. 5 shows another example based on FIG. 4 In this example the blade rear cavity 16 is separated from the heat shield cavity 25 by a lower seal 22 which extends between the foot 4 and the heat shield 7. In this example it extends between the axial heat shield section 14 and the blade foot 4, however it can also extend between the radial heat shield section 15 and the blade foot 4.

Typically the design pressure of the heat shield cavity 25 and the blade rear cavity 16 are practically identical or very close to each other, e.g. they differ by less than 10% or even less than 5% in total pressure. The two cavities have independent coolant supply. For such a design the lower seal 22 serves mainly as a safety in case one of the other seals sealing the blade rear cavity 16 fails.

All the explained advantages are not limited just to the specified combinations but can also be used in other combinations or alone without departing from the scope of the disclosure. Other possibilities are optionally conceivable, for example additional coolant feeds can be directed from the rotor 6 directly to the heat shield cavity 25 or from the blade 1 to the blade rear cavity. Additional or alternative coolant feeds from an upstream or downstream end can be foreseen without passing the coolant through the rotor, e.g. through the looking blade area.

To avoid high local stresses due to centrifugal forces during operation the first groove 11 can also have a smaller depth than shown in the FIGURES such that it does not extend into the line of stress caused by the blade load. Such a first groove 11 can also serve the purpose of reducing thermal stresses.

The arrangement of the blade rear cavity radially outside of the heat shield cavity leads to a fail-save design. If one of the seals towards the hot gas side, i.e. the radial heat shield seal 20 or the upper seal 19 fails, the pressure difference across the remaining seals, i.e. rear seal 33 and lower seal 22 will increase and sufficient coolant flow will enter the blade rear cavity to purge it and thereby avoid hot gas ingestion.

The inventions claimed is:

1. A gas turbine blade comprising:

a blade platform having a trailing edge side, a pressure side, a suction side, and a leading edge side;

an airfoil connected to the blade platform, and a first groove formed in the trailing edge side of the platform, wherein the first groove extends between the pressure side and the suction side, and wherein the first groove extends in an axial direction below a root of a trailing edge of the airfoil, the first groove configured so that the trailing edge side of the blade platform is not rigidly connected to a foot of a blade, a trailing edge side seal groove formed in the trailing edge side of the blade platform closer to a platform surface of the blade platform facing the airfoil than the first groove, wherein the trailing edge side seal groove extends between the pressure side and the suction side, and wherein a depth of the trailing edge side seal groove in axial direction is smaller than a depth of the first groove;

a main seal above the first groove; and a rear seal positioned adjacent the first groove below the trailing edge side seal groove, the rear seal extending radially from the main seal to the foot of the blade to control leakage from the blade to a heat shield cavity of a heat shield downstream of the blade;

an upper seal above the first groove, a portion of the upper seal positioned in the trailing edge side seal groove of the blade platform; and a lower seal below the first groove that extends between the foot and the heat shield to separate a blade rear cavity from the heat shield cavity.

2. The gas turbine blade according to claim 1, wherein the first groove has an axial depth that enters into a line of stress created by a blade load.

3. The gas turbine blade according to claim 1, wherein the trailing edge side seal groove is configured to hold a strip seal.

4. The gas turbine blade according to claim 1, wherein the blade comprises a seal groove extending to the trailing edge of the blade platform on the pressure side of the blade platform and/or on the suction side of the blade platform for receiving the main seal above the first groove.

5. The gas turbine blade according to claim 1, wherein the blade comprises a seal groove on the pressure side of the platform and/or on the suction side of the platform for receiving the rear seal extending radially inwardly below the first groove.

6. A gas turbine rotor heat shield for separating a space region through which hot working medium flows from a space region inside a rotor arrangement of a gas turbine through which coolant flows, comprising:

a platform which forms an axial heat shield section and which is arranged substantially parallel to a surface of a rotor, wherein the rotor heat shield includes a radial heat shield section arranged at one end of an axial heat shield section, the radial heat shield section extending radially in a direction away from a surface of the axial heat shield section towards a hot gas side of the heat shield;

a first end of the radial heat shield section being adjacent an upper seal extending between the rotor heat shield and a blade platform;

a second end of the radial heat shield section being adjacent the axial heat shield section;

a blade rear cavity being defined between the radial heat shield section, the upper seal, and the blade platform such that a heat shield cavity of the rotor heat shield and the blade rear cavity are independently suppliable with coolant; and a lower seal that separates the heat shield cavity from the blade rear cavity below the upper seal.

7. The gas turbine rotor heat shield according to claim 6, wherein the radial heat shield section is extending at an angle of more than 30° in a direction away from the surface of the axial heat shield section towards the hot gas side.

8. The gas turbine rotor heat shield according to claim 6, wherein the radial heat shield section comprises a kink to bridge a gap between the blade platform and the rotor heat shield for holding the upper seal.

9. A turbine comprising:

a blade comprising:

a blade platform having a trailing edge side, a pressure side, a suction side, and a leading edge side;

an airfoil connected to the blade platform, and a first groove formed in the trailing edge side of the blade platform, wherein the first groove extends between the pressure side and the suction side and wherein the first groove extends in an axial direction below a trailing edge of the airfoil, and a rotor heat shield for separating a space region through which hot working medium flows from a space region inside a rotor arrangement of the turbine, wherein the rotor heat shield comprises an axial heat shield section which is arranged substantially parallel to a surface of a rotor of the rotor arrangement, wherein the rotor heat shield comprises a radial heat shield section at an upstream end of the axial heat shield section, the radial heat shield section extending in a direction away from a surface of the axial heat shield section towards a hot gas side of the rotor heat shield such that a blade rear cavity is defined between the radial heat shield section and at least one of the blade platform and a foot of the blade;

a main seal above the first groove and above the blade rear cavity;

a rear seal positioned adjacent the first groove, the rear seal extending radially from the main seal toward the foot of the blade to control leakage from the blade to a heat shield cavity of the rotor heat shield downstream of the blade; and a lower seal arranged between the radial heat shield section and the rear seal below the blade rear cavity for separating the blade rear cavity from the heat shield cavity.

10. The turbine according to claim 9, wherein the blade comprises a trailing edge side seal groove formed in the trailing edge side of the blade platform closer to a platform surface facing the airfoil than the first groove, wherein the trailing edge side seal groove extends between the pressure side and the suction side, and wherein the depth of the trailing edge side seal groove in axial direction is smaller than the depth of the first groove.

11. The turbine according to claim 10, wherein the turbine comprises an upper seal arranged between the trailing edge side seal groove and the radial heat shield section.

12. The turbine according to claim 9, wherein the blade comprises a seal groove for receiving the rear seal on the pressure side of the blade platform and/or on the suction side of the blade platform, the rear seal extending radially inwardly below the first groove for sealing a space formed between adjacent blades of one turbine row at a downstream end towards the blade rear cavity.

13. A turbine comprising:

a blade comprising:

a blade platform having a trailing edge side, a pressure side, a suction side, and a leading edge side;

an airfoil connected to the blade platform, and a first groove formed in the trailing edge side of the blade platform, wherein the first groove extends between the pressure side and the suction side and wherein the first groove extends in an axial direction below a trailing edge of the airfoil, and a rotor heat shield for separating a space region through which hot working medium flows from a space region inside a rotor arrangement of the turbine, wherein the rotor heat shield comprises an axial heat shield section which is arranged substantially parallel to a surface of a rotor of the rotor arrangement, wherein the rotor heat shield comprises a radial heat shield section at an upstream end of the axial heat shield section, the radial heat shield section extending in a direction away from a surface of the axial heat shield section towards a hot gas side of the rotor heat shield such that a blade rear cavity is defined between the radial heat shield section and at least one of the blade platform and a foot of the blade;

a main seal above the first groove and above the blade rear cavity; and a rear seal positioned adjacent the first groove, the rear seal extending radially from the main seal toward the foot of the blade to control leakage from the blade to a heat shield cavity of the rotor heat shield downstream of the blade; and a lower seal below the first groove that extends between the foot of the blade and the heat shield to separate the blade rear cavity from the heat shield cavity.

14. The turbine of claim 13, wherein the radial heat shield section comprises a kink to bridge a gap between the blade platform and the rotor heat shield for holding an upper seal positioned above the first groove, the radial heat shield, and the lower seal between the blade platform and the rotor heat shield.

15. The turbine of claim 13, comprising:

an upper seal above the lower seal, the first groove, and the blade rear cavity, the upper seal extending from the blade platform to the rotor heat shield.

16. The turbine of claim 13, wherein the lower seal is configured so that coolant is independently suppliable to the heat shield cavity and the blade rear cavity.

17. The turbine of claim 13, wherein the hot gas side of the rotor heat shield is a side of the rotor heat shield that is closest to the space region through which the hot working medium flows.

* * * * *